United States Patent [19]

Mazumder

[11] Patent Number: 4,522,122

[45] Date of Patent: Jun. 11, 1985

[54] FAST IMPACT HAMMER FOR HIGH SPEED PRINTER

[75] Inventor: Ali T. Mazumder, Waterloo, Canada

[73] Assignee: NCR Canada Ltd - NCR Canada Ltee, Mississauga, Canada

[21] Appl. No.: 491,117

[22] Filed: May 3, 1983

[51] Int. Cl.[3] ..... B41J 9/42

[52] U.S. Cl. ..... 101/93.02; 101/93.29

[58] Field of Search ..... 101/93.02, 93.03, 93.18, 101/93.21, 93.28, 93.29, 93.34; 335/268

[56] References Cited

U.S. PATENT DOCUMENTS

| | | | |
|---|---|---|---|
| 1,648,674 | 11/1927 | Carichoff | 335/268 |
| 3,110,250 | 11/1963 | Fradkin | 101/93.34 |
| 3,184,651 | 5/1965 | Albosta | 335/268 |
| 3,200,739 | 8/1965 | Antonucci | 101/93.34 |
| 3,266,418 | 8/1966 | Russo | 101/93.34 |
| 3,335,659 | 8/1967 | Schacht et al. | 101/93 |
| 3,356,199 | 12/1967 | Robinson | 101/93.29 |
| 3,678,847 | 7/1972 | Pear, Jr. et al. | 101/93.02 |
| 3,705,370 | 12/1972 | Chai et al. | 335/229 |
| 3,707,122 | 12/1972 | Cargill | 101/93 C |
| 3,741,113 | 6/1973 | Mako et al. | 101/93 |
| 3,745,497 | 7/1973 | Cavella | 335/266 |
| 3,900,094 | 8/1975 | Larsen et al. | 101/93.05 X |

FOREIGN PATENT DOCUMENTS

| | | | |
|---|---|---|---|
| 0022480 | 1/1981 | European Pat. Off. | 101/93.02 |
| 2238605 | 8/1972 | Fed. Rep. of Germany | 101/93.02 |

*Primary Examiner*—Edgar S. Burr
*Assistant Examiner*—John A. Weresh
*Attorney, Agent, or Firm*—Albert L. Sessler, Jr.; George Jameson

[57] ABSTRACT

An impact hammer assembly, suitable for high speed MICR printing, is disclosed. The impact hammer assembly comprises an impact hammer having first and second flanged portions respectively positioned at first and second ends along a first longitudinal surface of the impact hammer and a hammer face positioned at the second end of the hammer on a second longitudinal surface opposite from the first longitudinal surface. The hammer is pivotally mounted at a pivot between the first and second flanged portions for movement between a rest position and a print position. A first electromagnetic coil positioned adjacent to the first flanged portion is energized by a first pulse from a control circuit to impel the hammer face toward the print position. A second electromagnetic coil positioned adjacent to the second flanged portion is energized by a second pulse from the control circuit to cause a fast return of the hammer to the rest position. A spring is connected to the hammer at a point between the pivot and the second flanged portion to provide damping of oscillations of the hammer upon the return of the hammer to the rest position.

16 Claims, 5 Drawing Figures

FAST IMPACT HAMMER FOR HIGH SPEED PRINTER

BACKGROUND OF THE INVENTION

The present invention relates to printers and particularly to electromagnetically-operated print hammer assemblies for high speed impact printers.

Many different types of electromagnetically-operated impact printers have been proposed. Such impact printers utilize one or more electromagnets or solenoids to impart a driving force to a print hammer to drive the hammer against a print or type wheel, to return the hammer to its rest position after an impact printing, or both to drive the hammer to a print position and then to return it to its rest position after an impact printing. Examples of such proposed prior art impact printers, which comprise the background art known to applicant at the time of the filing of this application, are described below.

U.S. Pat. No. 3,335,659 discloses an impact printer in which a print magnet causes a print hammer to impact-print and then two electromagnetic coils are selectively energized to provide damping for the print hammer during its return movement.

U.S. Pat. No. 3,745,497 discloses an impact printer in which a pulse simultaneously energizes two electromagnetic coils to cause the front portion of an actuating arm to be pivoted upward and thrust an associated hammer pin upward to its printing position. At the end of the pulse, the coils de-energize, causing the front portion to be pulled down by a spring to its rest position.

U.S. Pat. No. 3,707,122 discloses an impact line printer in which each print hammer is normally maintained in a spring loaded position by an associated permanent magnet. When it is desired to print with a hammer, an associated coil is energized to produce an opposing magnetic field to counteract the field of the associated permanent magnet and allow associated leaf springs to propel the head of the hammer against an associated type wheel. Upon rebound of the print hammer, the associated coil is de-energized and the associated permanent magnet catches and locks the print hammer.

U.S. Pat. No. 3,705,370 discloses an impact printer which includes a three-legged core of magnetic material having upper, middle and lower legs. An armature, which is pivotally supported at its central portion adjacent to the middle leg, has a hammer face at its upper end spaced from the end of the upper leg to define an air gap therebetween and an operating winding around a pole piece mounted on its lower end abutting the lower leg. The upper leg of the core contains a permanent magnet or an upper winding to normally attract the upper end of the armature to its rest position against the permanent magnet. When the operating winding is pulsed, the holding effect of the permanent magnet or upper winding is overcome and the armature rotates to cause the hammer face to impact print paper and ribbon against a type wheel. When the pulse to the operating winding is terminated, the magnetic flux of the permanent magnet or upper winding restores the armature to its rest position.

U.S. Pat. No. 3,741,113 discloses an impact printer which includes first and second three-legged cores of magnetic material with a winding or coil on the middle leg of each core. An armature is pivotally mounted at one end thereof between the two cores. The armature has a hammer face at the other end and a projecting intermediate portion disposed to move within the winding on the first core when that winding is energized to enable the hammer face to impact a type wheel. The winding on the second core is later energized to damp oscillations and improve settle-out.

Because of the very tight quality requirements for MICR (magnetic ink character recognition) prints on bank checks and other financial documents, impact printing technology using total transfer type media, is the best method of printing MICR characters known to date. However, the long cycle time (settling time) of the impacting device (print hammer) imposes limitations on printing speed and thus the document throughput requirements.

SUMMARY OF THE INVENTION

In a preferred embodiment of the invention there is provided an electromagnetically-operated, impact hammer assembly suitable for high speed MICR (magnetic ink character recognition) printing. The impact hammer assembly is comprised of: a print hammer pivotally mounted to a pivot located between first and second end portions of the print hammer for movement between a rest position and a print position, first and second electromagnetic coils positioned on the same side of the print hammer respectively adjacent to the first and second end portions of the print hammer, and a circuit for supplying a first pulse to the first coil to cause the print hammer to move to the print position and a second pulse to the second coil after the print hammer has printed to rapidly cause the print hammer to return to the rest position.

It is, therefore, an object of this invention to provide an improved electromagnetically-operated, impact printer hammer.

Another object of the invention is to provide an electromagnetically-operated, fast print hammer for high speed MICR printing.

A further object of the invention is to provide a high speed MICR printer having a reduced hammer cycle time for an electromagnetically-operated print hammer.

BRIEF DESCRIPTION OF THE DRAWINGS

These and other objects, features and advantages of the invention, as well as the invention itself, will become more apparent to those skilled in the art in the light of the following detailed description taken in consideration with the accompanying drawings wherein.

DESCRIPTION OF THE PREFERRED EMBODIMENT

Figure 1:
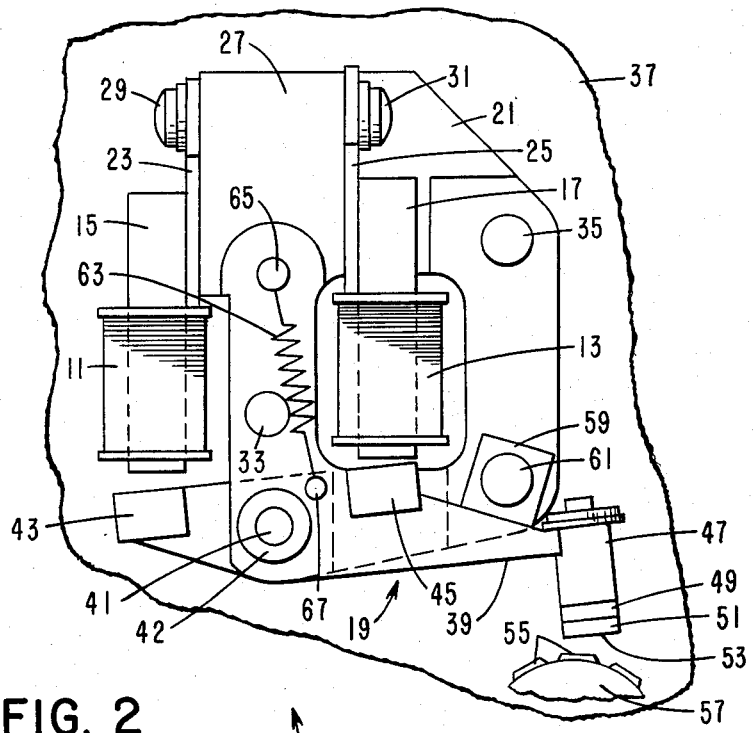
FIG. 1 is a partial schematic plan view of an impact hammer assembly in accordance with a preferred embodiment of the invention.

Referring now to the drawings, FIG. 1 illustrates an impact hammer assembly in accordance with a preferred embodiment of the invention. The impact hammer assembly comprises electromagnetic hammer and return coils 11 and 13 respectively positioned on the lower ends of magnetic core members 15 and 17, a print hammer 19 and a base 21 which holds the coils 11 and 13 and hammer 19 together in relative, preselected spaced relationships.

Core members 15 and 17 are respectively riveted to thin, parallel upstanding plates 23 and 25. The plates 23 and 25 are secured to opposite sides of an upstanding portion 27 of the base 21 by means of screws 29 and 31. Base 21, in turn, is secured by set screws 33 and 35 to a mounting plate 37 which holds the entire printing mechanism together.

Elongate hammer beam 39 of hammer 19 is pivotally supported by a pivot pin 41. A lower portion (not shown) of the pivot pin 41 is press fitted into the base 21. A retainer, such as a snap ring 42, is inserted in a slot (not shown) in the upper end of the pivot pin 41 to prevent the beam 39 from slipping off the pin 41.

Flanges 43 and 45 are brazed onto the hammer beam 39 on opposite sides of the pivot pin 41, and substantially equidistant from the pin 41, so that they respectively face the coils 11 and 13. The flange 43 is located at one end of the hammer beam 39. Located at the other end of the beam is a hammer head 47.

An elastomeric compressible member 49 may be bonded, molded or otherwise suitably retained between the hammer head 47 and a hammer tip 51 for the proper print quality when MICR impact printing is desired. When non-MICR printing is desired, the compressible member 49 may be omitted and the hammer head 47 may be a solid piece which includes the hammer tip 51.

The hammer tip 51 has a substantially flat face 53 for impacting an ink ribbon (not shown) and a document or print paper (not shown) against type characters 55 positioned on the surface of, for example, a type or print wheel 57. The type wheel 57 is rotatably mounted to the mounting plate 37.

For lightness, the base 21 and mounting plate 37 may each be made of aluminum. The coils 11 and 13, pivot pin 41 and flanges 43 and 45 may each be made of 2½% silicon iron. For durability the hammer beam 39, hammer head 47 and hammer tip 51 may be made of steel. Obviously other suitable materials could be used in place of those described above.

In a printing operation, the print hammer 19 moves between a rest position and a print position. The position of an elastomeric backstop 59 determines the rest position of the hammer 19 by limiting the backward or return motion of the hammer beam 39 after the tip 51 has impact printed a character 55 on a document. Note that the hammer 19 in FIG. 1 is shown in its rest position.

Backstop 59 is mounted on a post 61 which is press-fitted into a hole (not shown) in the base 21. A weak spring 63, mounted between a post 65 on the base 21 and a post 67 on the hammer beam 39 between the pivot pin 41 and the return coil 13, is utilized to bias the print hammer 19 to the rest position against the backstop 59 after the hammer 19 has impact printed a character 55.

In the initial set up of the impact printer shown in FIG. 1, the screws 33 and 35 are positioned to loosely hold the base 21 and mounting plate 37 together. Slots (not shown) in the base 21 under the screws 33 and 35 enable the base to be moved relative to the mounting plate 37 to set up the desired hammer gap or flight distance $F_D$ between the hammer tip 51 and the type wheel 57 when the hammer 19 is in its rest position against the backstop 59. When the desired $F_D$ is obtained, the screws 33 and 35 are tightened to securely hold the base 21 to the mounting plate 37 to maintain that desired flight distance $F_D$ between the tip 51 and the type wheel 57.

After $F_D$ is initially set, the screws 29 and 31 are loosened. Slots (not shown) in the thin plates 23 and 25 under the screws 29 and 31 enable the cores 15 and 17, and hence the coils 11 and 13, to be moved relative to the upstanding portion 27 of the base 21. By shifting the core 15 around, the air gap $G_{HC}$ between the hammer coil 11 and the flange 43 can be set to a desired distance when the hammer 19 is in its rest position. The screw 29 is then tightened to maintain this $G_{HC}$ gap. Similarly, by shifting the core 17 around, the air gap $G_{RC}$ between the return coil 13 and the flange 45 can be set to a desired distance when the hammer is in its rest position. The screw 31 is then tightened to maintain this return coil air gap.

It should be noted at this time that the pivot pin 41 is so located along the hammer beam 39 that the distance $T_L$ (torque length) from the pivot pin 41 to the line passing perpendicularly through the center of the flange 43 is approximately one-half the distance $P_L$ (print length) from the pivot pin 41 to the line passing perpendicularly through the center of the hammer tip 51.

With the above-noted $P_L/T_L$ ratio of distances, when a MICR printing application is desired for the impact printer of FIG. 1, the base 21 and cores 15 and 17 are initially sequentially shifted around to provide $F_D$, $G_{HC}$ and $G_{RC}$ gaps suitable for MICR printing. Exemplary $G_{HC}$, $G_{RC}$ and $F_D$ gaps or distances that are suitable for MICR printing are shown in TABLE 1 below for the "REST" and "PRINT (IMPACT)" positions of the hammer 19.

TABLE 1

| | REST | PRINT (IMPACT) |
|---|---|---|
| $G_{HC}$ | 0.034 inches | 0.005 inches |
| $G_{RC}$ | 0.005 inches | 0.100 inches |
| $F_D$ | 0.090 inches | 0.000 inches |

Figure 2:
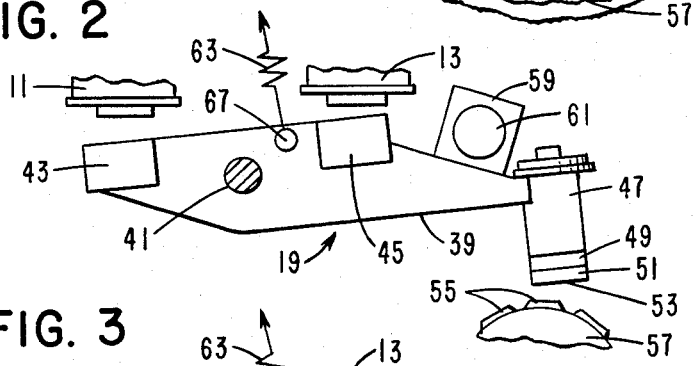
FIG. 2 is a simplified partial schematic diagram of the invention of FIG. 1 showing the print hammer in its rest position.
Figure 3:
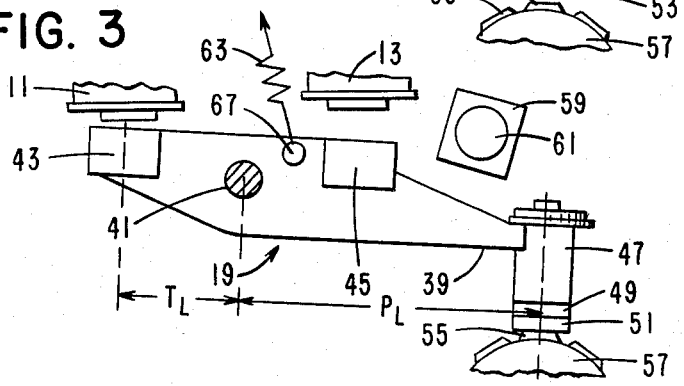
FIG. 3 is a simplified partial schematic diagram of the invention of FIG. 1 showing the print hammer in its print position.

FIGS. 2 and 3 illustrate simplified partial schematic diagrams of the impact print hammer assembly of FIG. 1, showing more clearly the $G_{HC}$, $G_{RC}$ and $F_D$ gaps of the print hammer 19 in its "REST" and "PRINT (IMPACT)" positions, respectively.

It should be noted that in MICR printing, and especially in the MICR printing of bank checks and other financial documents, a minimum $F_D$ of 0.090 inches is required between the hammer face 53 and the type wheel 57 to allow an optimum velocity to be achieved for optimum MICR ink transfer to a print paper. In such MICR printing of financial documents, provision must be made for the use of a carrier envelope (having a thickness of approximately 0.021 inches) when a given document cannot be imprinted, the given document inside the envelope (such document having a thickness of approximately 0.016 inches) and a MICR ink ribbon (having a thickness of approximately 0.002 inches). The combined thickness of the carrier envelope, document and MICR ink ribbon is approximately 0.039 inches. In such a case, when $F_D=0.090$ inches, the hammer tip 51 would only move a distance of approximately 0.051 inches before the tip 51 impacted the envelope (containing the document) and MICR ink ribbon against a character 55 on the type wheel 57. Any distance less than this 0.051 inches would not allow the hammer 19 to reach its optimum velocity for proper MICR ink transfer.

It should, of course, be realized that for a non-MICR printing application, the $G_{HC}$, $G_{RC}$ and $F_D$ gaps shown in TABLE 1 above could be considerably reduced to substantially increase the printing speed of the printer of FIG. 1.

The printing operation of the impact printer hammer assembly of FIG. 1 will now be discussed by referring to FIGS. 2, 3 and 4.

Figure 4:
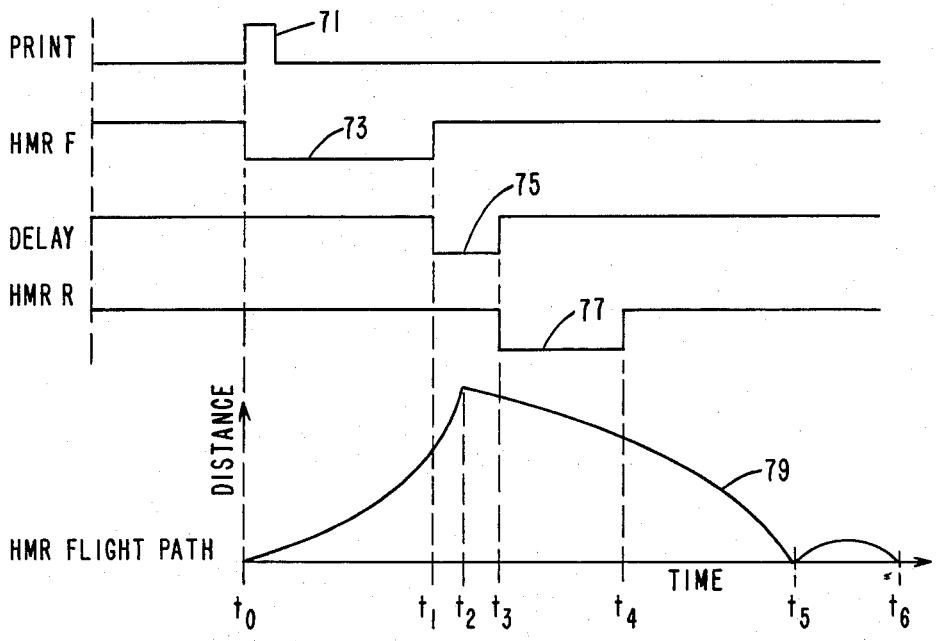
FIG. 4 illustrates timing waveforms useful in understanding the operation of the impact hammer assembly of FIG. 1 and the control circuit of FIG. 5.

FIG. 4 illustrates (in part) the waveforms of the current pulses 73 and 77 which are used during each printing operation to selectively energize the coils 11 and 13 of FIG. 1 and the waveform of the flight path 79 of the print hammer 19 during a hammer cycle period between times $t_0$ and $t_6$, in which distance is plotted against time.

As shown in FIG. 2, when no characters are being printed, the print hammer 19 is held in its rest position against the backstop 59 by the bias of the spring 63. In this rest position the gaps $G_{HC}$ and $F_D$ are respectively at their maximum values, while the gap $G_{RC}$ is at its minimum value.

Each time that a character on the type wheel is to be printed, a hammer fire (HMR F) pulse 73 (FIG. 4) of current is applied at time $t_0$ from a control circuit (to be explained) to energize the hammer coil 11. Upon being energized, the coil 11 exerts an electromagnetic attraction on the flange 43. As a result, the print hammer 19 pivots around the pivot 41. This impels the hammer head 47 toward the type wheel 57, causing the hammer face 53 to impact a document (not shown) and an ink ribbon (not shown) against the character 55 on the type wheel 57.

The HMR F pulse 73 is applied for the period of time between time $t_0$ and time $t_1$. At time $t_2$, shortly after the end of the HMR F pulse 73, the hammer face 53 impacts against the type wheel 57. The time period $t_0$–$t_2$ is known as the flight time of the hammer 19, or the time that it takes the hammer 19 to move from its rest position against backstop 59 to its point of impact printing. For MICR impact printing, when $F_D=0.090$ inches, the hammer flight time is approximately equal to 2.7 milliseconds. With non-MICR printing the flight time could be reduced significantly by selectively reducing the gaps $G_{HC}$, $G_{RC}$ and $F_D$, as discussed before.

Shortly after the hammer tip 51 impacts against the type wheel 57, the hammer 19 rebounds away from the type wheel 57. The tension of the spring 63, which also helps to break the contact between tip 51 and wheel 57, then slowly starts to pull the hammer 19 back towards its rest position.

To reduce the hammer settling time (hammer cycle time) of the hammer 19 and hence increase the printing speed of the print hammer 19, a hammer return (HMR R) pulse 77 (FIG. 4) of current is applied from the control circuit (to be explained) at time $t_3$ (shortly after impact) to energize the return coil 13 and thereby accelerate the return of the hammer 19 to its rest position.

It should be noted that the pulse 77 is generated after the magnetic field built up in the coil 11 by current pulse 73 has substantially collapsed. As a result, there is no interaction between the successively produced magnetic fields in coils 11 and 13.

In response to the current pulse 77, the coil 13 exerts an electromagnetic attraction on the flange 45, rapidly pulling the hammer 19 up towards its resting position against the backstop 59. As shown in FIG. 4, the pulse 77 is terminated at time $t_4$, before the hammer 19 reaches the backstop 59. The momentum of the hammer 19 plus the tension of the spring 63 enable the hammer 19 to continue its return path to the backstop 59. At time $t_5$ the hammer 19 impacts against the backstop 59 and rebounds. The tension of the spring 63 returns the hammer 19 to its rest position against the backstop 59 at time $t_6$, rapidly damping out any subsequent rebound oscillations.

It should be recalled that the torque length $T_L$ is approximately equal to one-half of the print length $P_L$ (or $P_L=2T_L$). Consequently, coil 13 requires substantially less current therethrough to initiate the return of the hammer 19 to its rest position than coil 11 requires to impel the hammer 19 toward its print position. This is an important feature of the invention. Exemplary values of the HMR F pulse 73 and HMR R pulse 77 are 3 amperes and 0.8 amperes, respectively.

Figure 5:
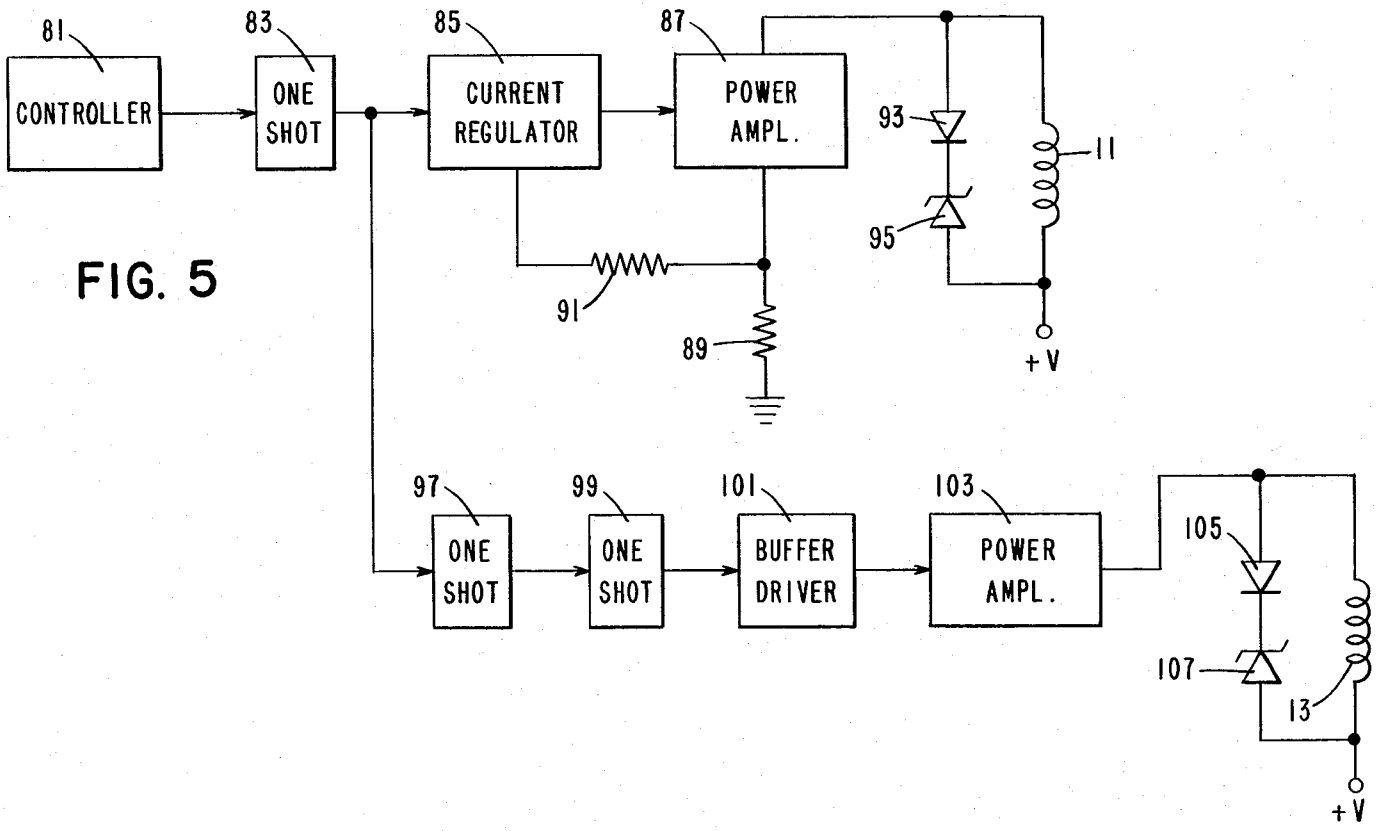
FIG. 5 is a schematic circuit block diagram of a control circuit for selectively supplying drive pulses for the hammer and return coils of FIG. 1.

The control circuit for supplying the HMR F pulse 73 and HMR R pulse 77 will now be explained by referring to the control circuit shown in FIG. 5 in conjunction with the waveforms shown in FIG. 4.

Each time that a character 55 (FIG. 1) is to be printed, a controller 81 rotates the type wheel 57 (FIG. 1) so that the desired character 55 is directly opposite from the hammer face 53. After the wheel 57 is properly positioned, the controller 81 supplies a print pulse 71 of, for example, ten microseconds in duration to a one-shot multivibrator (OS) 83. The leading, positive-going edge of the print pulse 71 triggers the one-shot 83 to develop the HMR fire pulse 73. This one-shot 83 controls the pulse width of the HMR F pulse 73, which pulse width determines how long the hammer coil 11 (FIG. 1) will be energized.

The HMR F pulse 73 is applied to a current regulator 85, such as a hybrid current regulator manufactured by NCR Corporation, Dayton, Ohio and having NCR part number 006-006120. In response to the pulse 73, current regulator 85 supplies an input drive current to turn on a power amplifier 87, which may be a Darlington power amplifier. Coil 11 acts as the load for the power amplifier 87.

When the power amplifier 87 is turned on by the input drive current from regulator 85, current flows from a positive DC voltage source (+V) through the coil 11, through amplifier 87 and through a resistor 89 to ground. The amplitude of the current pulse flowing through the coil 11 is regulated by the regulator 85, the resistor 89 and a resistor 91 connected between the top of resistor 89 and a feedback input to the current regulator 85. Exemplary values of the resistors 89 and 91 are 0.75 ohms and 47 ohms, respectively. For MICR printing the current through coil 11 may be set via the regulator 85 to be about 3 amperes. With 3 amperes of current flowing through the coil 11, a reference voltage of 2.25 volts will be dropped across the resistor 89 in normal operation.

The regulator 85 regulates the current through the coil 11 at, for example, 3 amperes by changing the amplitude of the input drive current to the power amplifier 87 as an inverse function of any change in the 2.25 volt reference voltage developed across the resistor 89.

Serially connected diode 93 and zener diode 95 are coupled across the coil 11 to suppress transient pulses across the coil 11 after the current pulse through the coil 11 is terminated at the end of the HMR F pulse 73.

The HMR F pulse 73 from the one-shot 83 is also used in the generation of the HMR R pulse 77. The trailing, positive-going edge of the HMR F pulse 73 triggers a one-shot 97 to develop a delay pulse 75. The trailing, positive-going edge of the delay pulse 75 is used to trigger a one-shot 99 to develop the HMR R pulse 77. The pulse width of the HMR R pulse 77, which is determined by the one-shot 99, determines how long the return coil 13 (FIG. 1) will be energized.

The HMR R pulse 77 is amplified by a buffer driver 101. The output of driver 101 is a drive current which is used to turn on a power amplifier 103, similar to the amplifier 87.

When turned on, the power amplifier 103 supplies a current pulse to energize the coil 13 to accelerate the return of the hammer 19 (FIG. 1) to its rest position. For MICR printing the peak current through the coil 13 is only about 0.8 amperes since, as mentioned before, coil 13 needs less current therethrough than coil 11 because of the above-noted $P_L/T_L$ ratio of distances.

Serially connected diode 105 and zener diode 107 are coupled across the coil 13 to suppress transient pulses across the coil 13 after the current pulse through the coil 13 is terminated at the end of the HMF R pulse 77.

Exemplary time periods in FIG. 4 for a MICR printing operation are as follows:

$t_1-t_0=1.5$ milliseconds
$t_2-t_1=0.3$ milliseconds
$t_3-t_2=0.4$ milliseconds
$t_4-t_3=1.0$ milliseconds
$t_5-t_4=1.4$ milliseconds
$t_6-t_5=0.8$ milliseconds The invention thus provides an electromagnetically-operated, impact hammer assembly suitable for high speed MICR and non-MICR printing operations. In a preferred embodiment of the invention the impact hammer assembly comprises a print hammer pivotally mounted between first and second end portions of the print hammer for movement between rest and print positions, first and second electromagnetic coils respectively positioned adjacent to the first and second end portions, and a control circuit for selectively energizing the first coil to cause the print hammer to move to the print position and the second coil to accelerate the return of the print hammer to its rest position after a printing operation.

While the salient features of the invention have been illustrated and described, it should be readily apparent to those skilled in the art that many changes and modifications can be made in the invention presented without departing from the spirit and true scope of the invention. Accordingly, the present invention should be considered as encompassing all such changes and modifications of the invention that fall within the broad scope of the invention as defined by the appended claims.

I claim:

1. An impact hammer assembly for a high speed printer, said assembly comprising:

a print hammer having a hammer head, a first portion, and a second portion located between said hammer head and said first portion, said print hammer being movably mounted at a pivot point between said first and second portions for movement between a rest position and a print position;

a first core of magnetic material disposed adjacent to and spaced from said first portion;

a first winding wound around said first core and being responsive to a first pulse for magnetically attracting said first portion to cause said hammer head to be impelled from the rest position toward the print position;

a second core of magnetic material positioned adjacent to and spaced from said second portion;

a second winding wound around said second core and being responsive to a second pulse for magnetically attracting said second portion to cause said hammer head to be impelled toward the rest position; and means for selectively generating the first pulse for said first winding during a first preselected period of time starting when said hammer head is substantially at the rest position and ending before said hammer head reaches the print position and generating the second pulse for said second winding during a second preselected period of time starting after said hammer head has rebounded from the print position and ending before said hammer head reaches the rest position, said generating means including first circuit means for developing the first pulse for said first winding and second circuit means for developing the second pulse for said second winding.

2. The impact hammer assembly of claim 1 further including:

means connected to said print hammer between sdid second portion and where said print hammer is movably mounted for biasing said print hammer toward the rest position.

3. The impact hammer assembly of claim 1 further including:

means connected to said print hammer for biasing said print hammer toward the rest position.

4. The impact hammer assembly of claim 1 further including:

a frame having a pivot for movably mounting said print hammer thereon; and means for mounting said first and second cores to said frame.

5. The impact hammer assembly of claim 4 further including:

a backstop mounted to said frame for determining the rest position for said print hammer.

6. The impact hammer assembly of claim 5 wherein: said backstop is made of elastomer.

7. The impact hammer assembly of claim 1 wherein: said first circuit means developes a current regulated first pulse for said first winding; and said second circuit means includes a delay circuit for developing the second pulse for said second windings.

8. The impact hammer assembly of claim 1 wherein said first circuit means includes:

first means responsive to a print pulse for producting a third pulse and second means responsive to the third pulse for developing the first pulse for said first winding; and said second circuit means includes delay means responsive to the third pulse for developing the second pulse for said second winding.

9. The impact hammer assembly of claim 8 wherein:

said second means includes a current regulator for developing a current regulated first pulse for said first winding.

10. The impact hammer assembly of claim 1 wherein:

said first winding contains a larger number of turns than said second winding.

11. The impact hammer assembly of claim 1 wherein said print hammer comprises:

a beam having first and second elongate sides with said first and second portions being respectively disposed at first and second end portions along said first elongate side; and an extension from said second elongate side at said second end portion, said extension having a print hammer face for impacting a document to print thereon when said first winding receives the first pulse.

12. The impact hammer assembly of claim 11 wherein:

said first winding contains a larger number of turns than said second winding.

13. The impact hammer assembly of claim 11 wherein:

said first circuit means develops a current regulated first pulse for said first winding; and said second circuit means is coupled to said first circuit means and includes a delay circuit for developing the second pulse for said second winding.

14. The impact hammer assembly of claim 13 further including:

means connected to said beam between said second portion and where said print hammer is movably mounted for biasing said beam toward the rest position.

15. The impact hammer assembly of claim 14 further including:

a frame having a pivot for movably mounting said beam thereon;

means for mounting said first and second cores to said frame; and a backstop mounted to said frame for determining the rest position for said print hammer.

16. The impact hammer assembly of claim 15 wherein:

said biasing means is a spring.

* * * * *